United States Patent [19]

Neilson, Jr.

[11] Patent Number: 4,590,649

[45] Date of Patent: May 27, 1986

[54] JEWELRY CATCH

[75] Inventor: James D. Neilson, Jr., Greensboro, N.C.

[73] Assignee: Bailey & Wasson Trading Company, San Antonio, Tex.

[21] Appl. No.: 566,867

[22] Filed: Dec. 29, 1983

Related U.S. Application Data

[63] Continuation-in-part of Ser. No. 389,062, Jun. 16, 1982.

[51] Int. Cl.[4] ..... A44B 17/00

[52] U.S. Cl. ..... 24/616; 24/615

[58] Field of Search ..... 24/616, 615, 617

[56] References Cited

U.S. PATENT DOCUMENTS

| | | | |
|---|---|---|---|
| 493,188 | 3/1893 | Scofield . | |
| 889,230 | 6/1908 | Hoffman | 24/616 |
| 917,038 | 4/1909 | Forsell . | |
| 921,846 | 5/1909 | Kerley . | |
| 1,371,210 | 3/1921 | King | 24/616 |
| 1,414,838 | 5/1922 | Street . | |
| 2,173,818 | 9/1939 | Baumer . | |
| 2,858,593 | 11/1958 | Irizarry | 24/616 X |
| 3,165,804 | 1/1965 | Marosy | 24/616 |
| 3,299,679 | 1/1967 | Anderson . | |
| 3,421,341 | 1/1969 | Hodge . | |
| 3,543,356 | 12/1970 | Zimmermann . | |
| 3,793,858 | 2/1974 | Jones . | |
| 3,967,351 | 7/1976 | Rosenberg et al. | 24/616 |
| 4,024,607 | 5/1977 | Rosenberg et al. . | |
| 4,358,876 | 11/1982 | Colognori | 24/616 |

FOREIGN PATENT DOCUMENTS

| | | | |
|---|---|---|---|
| 3048 | of 1904 | United Kingdom | 24/616 |

*Primary Examiner*—Peter A. Aschenbrenner
*Attorney, Agent, or Firm*—Gunn, Lee & Jackson

[57] ABSTRACT

An improved jewelry catch comprising a folded pin adapted to be received within a rectangular box for releasable, locking engagement therewith for stringing jewelry on a jewelry chain and securing opposite ends of the jewelry chain. The folded portion of the pin includes a resilient, angle tab which extends through an opening in the box when the pin is received therein, thereby prohibiting rotation of the pin within the box and unintentional disengagement of the pin therefrom. The shape of the pin and box and the size tolerances therebetween further impede the rotation of the pin within the box and the unintentional disengagement of the pin therefrom. The pin may be readily disengaged from the box for the purpose of threading the pin through a minute hollow passage in a piece of jewelry by manually deflecting the tab through the box opening and pulling the pin outward from within the box.

3 Claims, 5 Drawing Figures

JEWELRY CATCH

BACKGROUND OF THE INVENTION

The present application is a continuation-in-part of U.S. patent application Ser. No. 389,062 entitled JEWELRY FASTENER APPARATUS filed June 16, 1982.

The present invention is directed toward an improved jewelry clasp or catch which allows a bead, charm, pearl, or other piece of jewelry to be readily attached to or removed from a jewelry chain, such as a necklace or bracelet. Conventional jewelry chains are provided with only one clasp, which is typically of sufficient size to accommodate the manual dexterity of the wearer so that the chain may be conveniently attached or removed. Furthermore, valuable pieces of jewelry are often small and generally have a minute hole or passage therethrough of approximately 0.08 inches or less in diameter by which the piece may be strung on the jewelry chain. Due to the size of the conventional clasp members secured to each end of the chain and the minute passage through the jewelry, however, the small pieces of jewelry strung on the chain typically become permanent fixtures thereto.

It has recently become fashionable to wear jewelry of the type, referred to in the trade as the "add-a-bead" type, whereby one or more pieces of jewelry may be readily attached to or removed from a chain, necklace or bracelet. The desirability of this type of jewelry over the conventional, permanent arrangement of jewels on a chain is readily apparent. The popularity of the "add-a-bead" type of jewelry has resulted in the development of a type of clasp whereby the latch member is designed to be threaded through the small hole in the jewelry. However, the latch member size restrictions dictated by the "add-a-bead" type of jewelry have created problems in designing a latch member which may also be adequately secured to the opposite end of the chain. The use of latch members incorporating previous designs has often resulted in the undesirable disengagement of the latch member and the resultant loss of or damage to the valuable pieces of jewelry strung on the chain.

The present invention provides an improved jewelry catch which may be incorporated into a jewelry chain with or without a conventional clasp. The improved jewelry catch satisfies the size requirements dictated by the "add-a-bead" type of jewelry while providing a more secure locking engagement than has heretofore been developed.

BRIEF DESCRIPTION OF THE PRIOR ART

Various types of clasps or snaps are disclosed in the prior art. For example, U.S. Pat. No. 917,038 discloses a spring ring snap typically used as part of the conventional jewelry clasp referred to hereinabove. U.S. Pat. No. 4,024,607 discloses a latch having a hook portion designed to overlay a portion of the wall of the keeper member. U.S. Pat. No. 3,299,679 discloses a dual key clasp having a locking insert which may be removably secured within a casing. The locking insert has a leg and opposed seat which yieldingly engage an ear and saw tooth projection, respectively, within the casing. U.S. Pat. No. 1,414,838 shows a casing having apertures in the top and bottom thereof adapted to receive the forward ends of a pair of opposed forked members.

U.S. Pat. No. 3,543,356 discloses a clasp for forming a closed loop from an elongated flexible strand, including a sleeve adapted for receiving a type of compressible latch, wherein the sleeve and latch are each secured to spaced apart portions of the strand. U.S. Pat. No. 921,846 discloses a chain clasp having tubular male and female members, the male member having a boss which projects through a slot in the female member and engages the forward wall of the slot. U.S. Pat. No. 3,421,341 discloses a plate designed to receive a notched catch having a resilient leg. U.S. Pat. No. 493,188 discloses a harness snap having a tongue member and a tongue receiving member. U.S. Pat. No. 3,793,858 shows a connector having a shaft adapted for engagement with a latching strip. U.S. Pat. No. 2,173,818 discloses a vest and collar holder comprising a rectangular sleeve, the top and bottom of which is provided with a pair of longitudinally aligned slots and a plurality of indents adapted to receive a pair of resilient wire adjusting clips.

All of the above listed patents are designed primarily to achieve the secure attachment of a first member to a second member. However, none of these patents are designed to permit either the first or second member to be threaded through the minute hole in a piece of jewelry. For example, U.S. Pat. No. 4,024,607 states that the latch plate is manufactured by a stamping operation and has a width between 0.09 inches and 0.15 inches, approximately three (3) to five (5) times the width of the pin disclosed in the present invention. That is, the clasps and snaps disclosed in the above referenced patents are not designed to achieve and the referenced patents do not teach the desired secure engagement of a first member to a second member, which first and second members are subject to the size restrictions or limitations dictated by the "add-a-bead" type of jewelry.

Unfortunately, clasps which have been heretofore specifically designed to permit the threading of a locking member through the piece of jewelry have not provided the desired secure engagement of opposite ends of the jewelry chain through the clasp. For example, Laurel Enterprises has disclosed a clasp which includes an arrow shaped pin, the forward end of which can be locked within a square or rectangular housing. However, the arrow shaped pin has a tendency to slip out of the housing, especially when the locking mechanism within the housing becomes worn. Leach & Garner Company has developed a clasp having an angled pin adapted to be received within a cylindrical housing. The angled edge of the pin extends into a slot in the cylindrical housing and abuts against the forward edge of the slot. However, the design of this clasp permits ready disengagement of the pin from the cylindrical housing by merely rotating the pin and pulling outward thereon. Thus, the cylindrical housing and/or pin may be accidentally rotated, thereby causing the pin to be disengaged from the housing, resulting in possible loss of or damage to pieces of jewelry on a chain.

The present invention provides a jewelry catch which accommodates the size restrictions or limitations dictated by the "add-a-bead" type of jewelry, while providing a jewelry catch pin which may be more securely engaged with a jewelry catch box than has heretofore been developed.

SUMMARY OF THE INVENTION

It is an object of the present invention to provide an improved jewelry catch adapted to provide releasable, locking engagement between opposite ends of a jewelry chain.

It is another object of the present invention to provide an improved jewelry catch which may be incorporated into a conventional jewelry chain, such as a necklace or bracelet, and which is designed to permit the ready addition or removal of pieces of jewelry to or from the chain.

It is still another object of the present invention to provide an improved jewelry catch which includes a pin adapted to be threaded or inserted through a hollow passage within a piece of jewelry, wherein the pin is manufactured by a stamping operation and thereafter folded.

It is a further object of the present invention to provide an improved jewelry catch comprising a pin adapted to be received within a rectangular box, the pin and box being specifically shaped and having specific size tolerances therebetween to permit insertion of the pin through a minute hollow passage within a piece of jewelry and prohibit rotation of the pin within the box and/or unintentional disengagement of the pin from the box.

It is a still further object of the present invention to provide an improved jewelry catch comprising a rectangular box having a square orifice on the forward end thereof, a ring on the rearward end thereof, and an opening in the box intermediate the forward and rearward ends. The ring is adapted to permit attachment of the rearward end of the box to one end of a jewelry chain. The box is adapted to receive a pin having a folded portion on the forward end thereof and an orifice on the rearward end thereof. The orifice is adapted to permit attachment of the rearward end of the pin to an opposite end of the jewelry chain. The folded portion of the pin includes a resilient, angled tab adapted for extending through the opening in the box and having a rearward facing edge adapted for abutting against a forward edge of the box formed by the opening. The pin is removed from the box by deflecting the tab through the opening and withdrawing the pin from the box.

These and other objects as well are achieved in the present invention, the preferred embodiment of which is described in detail hereinbelow.

DETAILED DESCRIPTION OF THE PREFERRED EMBODIMENT

Figure 1:
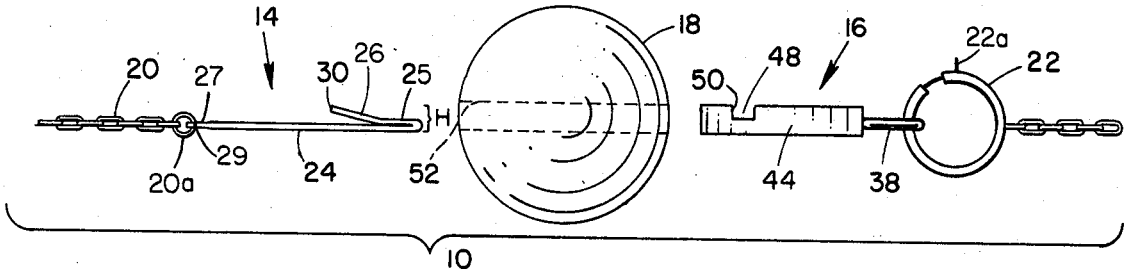
FIG. 1 is an exploded plan view of a jewelry chain and jewelry fastener apparatus incorporating the invention jewelry catch.
Figure 2:
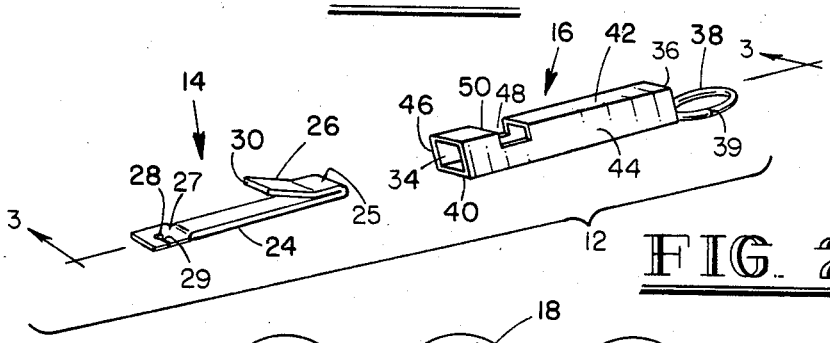
FIG. 2 is an exploded perspective view of the invention jewelry catch.

Referring to FIG. 1, a jewelry fastener apparatus 10 is illustrated incorporating the invention jewelry catch 12, as illustrated in FIG. 2 The invention catch 12 comprises a pin 14 adapted for releasable, locking engagement with a rectangular box 16. The invention jewelry catch 12 is designed to permit a piece of jewelry 18, such as a bead or pearl, to be readily attached to or removed from a jewelry chain 20. The jewelry fastener apparatus 10, illustrated in FIG. 1, also includes a spring activated ring member 22 appropriately secured to one end of chain 20. The ring member 22 is of sufficient size to accommodate the manual dexterity of the wearer and permit the wearer to readily attach or remove the chain 20. It is to be understood, however, that the invention jewelry catch 12 may also be incorporated into a chain 20 without the necessity of spring ring member 22.

Referring to FIG. 2, the invention jewelry catch 12 is illustrated in greater detail. The pin 14 comprises a substantially planer base 24 having a folded portion 25 on the forward end thereof and a grasping portion 27 on the rearward end thereof. The pin 14 is preferably manufactured by a stamping operation with the forward end thereafter bent or folded over approximately 180 degrees to form the folded portion 25 which is integral with base 24. The folded portion 25 of pin 14 includes a resilient, angled, outwardly protruding tab 26 having a substantially rectangular rearward facing edge 30. The grasping portion 27 on the rearward end of pin 14 includes an orifice 28 and a slit 29 for permitting attachment of the pin 14 to an end of chain 20 opposite the end of chain 20 to which ring member 22 is attached.

In the preferred embodiment, base 24 has a thickness of approximately 0.014 inches and grasping portion 27 has a thickness of approximately 0.010 inches with a maximum allowable variation of ±0.001 inches. Pin 14 has a length of approximately 0.360 inches with a maximum allowable variation of ±0.005 inches and grasping portion 27 has a width of approximately 0.050 inches with a maximum allowable variation of ±0.005 inches. Base 24 and folded portion 25 preferably have a width of approximately 0.036 inches with a maximum allowable width tolerance of 0.039 inches. Folded portion 25, including tab 26, has a length of approximately 0.155 inches with a maximum allowable variation of ±0.003 inches. As illustrated in FIG. 1, pin 14 has a height (H) from the bottom of base 24 to the top of tab 26 of approximately 0.050 inches with a maximum allowable height tolerance of 0.055 inches.

Figure 3:
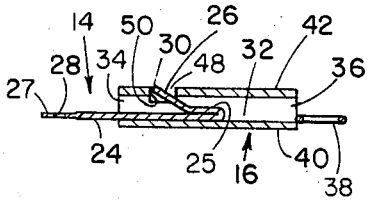
FIG. 3 is a cross sectional view of the invention jewelry catch taken along section lines 3—3 of FIG. 2 illustrating the invention jewelry catch with the pin engaged within the box.

As illustrated in FIG. 2 and FIG. 3, rectangular box 16 comprises a rectangular passage 32 therethrough adapted for receiving pin 14 therein. Box 16 comprises a square orifice 34 on the forward end thereof adapted to receive the forward end of pin 14 therethrough and a square orifice 36 on the rearward end thereof. Orifice 34 is square to thereby provide a maximum area through which to accommodate as large a pin 14 as allowable. An O-ring 38 is appropriately soldered to the rearward end of box 16 to permit the releasable engagement of ring member 22 to box 16 or otherwise connect the rearward end of box 16 to an end of chain 20. Box 16 includes a bottom or floor 40, a top or ceiling 42, and sides or walls 44, 46. Box 16 also includes an opening 48 extending through top 42 and a portion of sides 44, 46. As further illustrated in FIG. 2 and FIG. 3, box 16 includes a forward edge or face 50 defined or formed by opening 48.

In the preferred embodiment, box 16 has a length of approximately 0.220 inches with a maximum allowable variation of ±0.002 inches, bottom 40 and top 42 have an external width of approximately 0.050 inches with a maximum allowable variation of ±0.001 inches, and sides 44, 46 have an external height of approximately 0.050 inches with a maximum allowable variation of ±0.001 inches. Furthermore, bottom 40, top 42, and walls 44, 46 all have a thickness of approximately 0.005 inches with a maximum allowable variation of ±0.0005 inches. Opening 48 preferably has a length of approximately 0.045 inches with a maximum allowable variation of ±0.005 inches and a depth of approximately 0.019 inches with a maximum allowable variation of ±0.005 inches. The forward edge 50 of opening 48 is located approximately 0.040 inches from the forward end of box 16 with a maximum allowable variation of ±0.005 inches.

Figure 5:
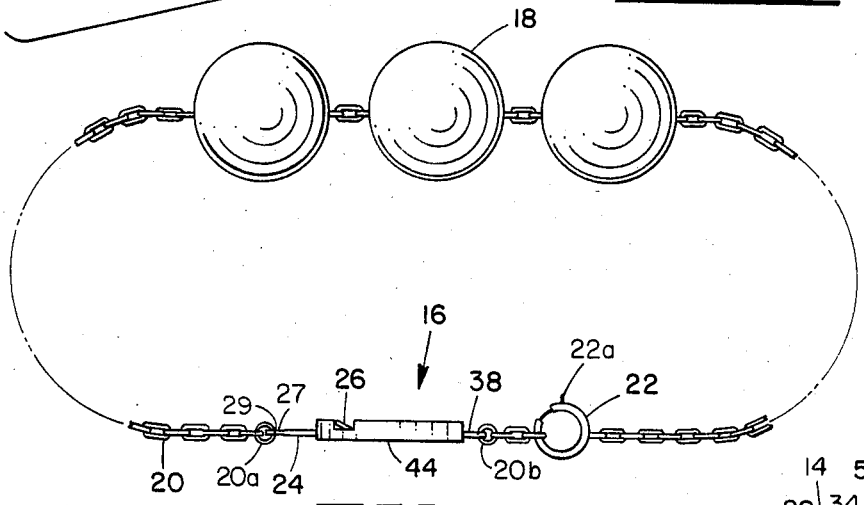
FIG. 5 is a plan view of an assembled jewelry chain and jewelry fastener apparatus incorporating the invention jewelry catch.
Figure 4:
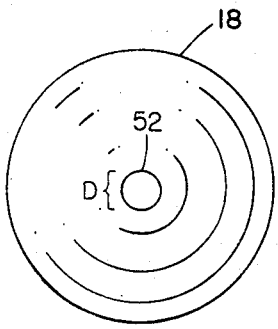
FIG. 4 is a plan view of a piece of jewelry having a minute passage through which the pin of the invention jewelry catch may be inserted.

The incorporation of the invention jewelry catch 12 into a conventional jewelry chain 20 and the utilization of invention catch 12 for the attachment or removal of one or more pieces of jewelry 18 may be achieved as follows. The rearward end of pin 14 is appropriately secured to an end of chain 20. This may be accomplished by merely inserting the connecting link 20*a* on one end of chain 20 through orifice 28 by means of slit 29, as illustrated in FIG. 1 and FIG. 5. Orifice 28 has a diameter of approximately 0.025 inches with a maximum allowable variation of 0.005 inches, the center of which is preferably located approximately 0.032 inches from the rear of pin 14 with a maximum allowable variation of ±0.005 inches. The rearward end of box 16 should also be attached to the opposite end of chain 20. This may be accomplished by merely deflecting slide member 22*a* of ring member 22 and inserting ring member 22 through O-ring 38, as illustrated in FIG. 1. This may also be accomplished by directly attaching connecting link 20*b* on the opposite end of chain 20 to O-ring 38 by means of slit 39, as illustrated in FIG. 5. The pin 14 may thereafter be inserted through the passage 52 extending through jewelry piece 18. It is to be understood that the hollow passage 52 through piece 18 will have a diameter (D), as illustrated in FIG. 4, of approximately 0.08 inches or less, the typical jewelry piece 18 having a total diameter of approximately 0.4 inches or less. Since pin 14 has a maximum width of 0.039 inches on the forward end thereof, a maximum width of 0.055 inches on the rearward end thereof, and a maximum height (H) of 0.055 inches, one or more pieces of jewelry 18 may be readily strung onto chain 20 by merely grasping portion 27 of pin 14 and inserting pin 14 through passage 52. Resilient tab 26 may be deflected downward, if necessary, to accommodate the insertion or threading of pin 4 through passage 52. It is also to be understood that pin 14 may also be inserted through a passage within a clip or other extended portion (not shown) of piece 18.

After a desirable number of pieces of jewelry 18 have been strung onto chain 20, the forward end of pin 14 is inserted into opening 34 and received within passage 32, as illustrated in FIG. 3. It is to be understood that when the forward end of pin 14 is initially inserted through opening 34, base 24 will slide along the inside of bottom 40 parallel therewith and resilient tab 26 will be deflected downward by the inside of top 42 toward base 24. However, once pin 14 has been extended a sufficient distance within box 16, angled tab 26 will extend upward through opening 48. In this position, a portion of edge 30 may extend above top 42 and a portion of edge 30 abuts against forward edge 50 in mating engagement therewith, as illustrated in FIG. 3. In this portion, pin 14 is in releasable, locking engagement with box 16, thereby forming a positive locking mechanism. Furthermore, the aforementioned size tolerances between pin 14 and box 16 and the locking engagement resulting from the extension of tab 26 through opening 48 and the abutment of edge 30 against edge 50, prohibit any rotation of the pin 14 within box 16 and/or unintentional disengagement of pin 14 from box 16.

When it becomes desirable to disengage pin 14 from box 16 for the purpose of removing one or more pieces of jewelry 18 from the chain 20 or for removing chain 20 from the wearer (if no ring member 22 is utilized), the resilient tab 26 is merely deflected downward toward base 24 through opening 48. The pin 14 may thereafter be withdrawn from box 16 by grasping rearward portion 27 and pulling pin 14 outward through opening 34. If it is desired that one or more pieces of jewelry 18 be removed from chain 20, the pin 14 is simply withdrawn through passage 52 to allow jewelry pieces 18 to slide off chain 20 over pin 14.

It is to be understood that the maximum internal width and internal height of box 16 (maximum external width of bottom 40 and top 42, maximum external height of walls 44, 46, and minimum thickness of bottom 40, top 42, and walls 44, 46) is approximately 0.042 inches and that the minimum internal width and internal height of box 16 (minimum external width of bottom 40 and top 42, minimum external height of walls 44, 46, and maximum thickness of bottom 40, top 42, and walls 44, 46) is approximately 0.038 inches. The dimensions referred to hereinabove thus provide limited or restricted size tolerances between pin 14 and box 16 when pin 14 is received within box 16. Furthermore, the rearward end of base 24 may be bent slightly upward so that the rearward end of base 24 protrudes outward from approximately the center of orifice 34 when pin 14 is received within box 16. Pin 14 preferably has a minimum hardness of 240 DPH, thereby providing the required resiliency for pin 14, including tab 26. Furthermore, pin 14 is designed for a maximum mismatch or maximum width tolerance between folded portion 25, including tab 26, and base 24 of 0.003 inches. That is, folded portion 25, including tab 26, may overlap the side(s) of base 24 by a maximum of 0.003 inches.

Pin 14 and box 16 may be constructed of gold, gold plated or gold filled metals, silver, or other precious metals. One or more links of chain 20 may also be located between the rearward end of box 16 and ring member 22, as illustrated in FIG. 5. Furthermore, O-ring 38 is provided with a sufficient diameter to prohibit the passage of jewelry pieces 18 beyond the rearward end of box 16. Spring ring member 22 is also preferably provided with a similar large diameter to prohibit the passage of the jewelry pieces 18 beyond ring member 22. The O-ring 38 and ring member 22 thus provide a jewelry stop on the respective ends of chain 20 and the pieces of jewelry 18 are thereby prohibited from falling off the chain 20 when the chain 20 is removed from the wearer by means of spring ring member 22.

While the invention improved jewelry catch has been described in connection with the preferred embodiment, it is not intended to limit the invention to the particular forms set forth, but on the contrary, it is intended to cover such alternatives, modifications, and equivalents as may be included within the spirit and scope of the invention as defined by the appended claims.

I claim:

1. An improved jewelry catch made of precious metals adapted to provide releasable, locking engagement between opposite ends of a jewelry chain, comprising:

a rectangular box having a forward end and a rearward end, said box having a generally square orifice on said forward end thereof, said box having a length of approximately 0.220 inches, a height of approximately 0.050 inches, and a width of approximately 0.050 inches, means on said rearward end thereof for attaching said box to a first end of said chain, and an opening in said box intermediate said forward and rear ends of said box, said opening extending the full width of said box; and a pin formed from a sheet of said precious metal having a forward end and a rearward end and having a width substantially equal to an inside width of said orifice, said pin adapted to be received within said box through said orifice, said forward end of said pin folded back against itself so said forward end points toward said rearward end, the folded portion is further bent at an intermediate point so that said bent portion diverges from said folded portion to form a resiliently depressable tab, said tab having a width substantially equal to the inside width of said orifice, said tab extending through said opening in said box when said pin is received therein, said tab having an edge facing said pin's rearward end for abutting against an edge of said opening facing said box's rearward end when said tab extends through said opening, a bottom portion of said front end of said pin contacting substantially the entire width of a bottom surface of said box while a portion of said tab edge contacts substantially the entire width of said opening edge when said pin is fully received within said box, said rearward end of said pin having a means thereon for attaching said pin to a second end of said chain opposite said first end, said pin having a length of approximately 0.360 inches, a width of approximately 0.036 inches, and a height of approximately 0.050 inches from a base of said bottom portion to a top of said tab, said pin further being sufficiently restricted in size to permit insertion thereof through a passage within a piece of jewelry, said passage having a diameter approximately 0.08 inches or less.

2. An improved jewelry catch, as recited in claim 1, wherein said pin is manufactured by a stamping operation and said forward end of said pin is thereafter folded to form said tab.

3. An improved jewelry catch, as recited in claim 2, wherein said pin includes a grasping portion on said rearward end thereof, said means for attaching said box comprises an O-ring connected to said rearward end of said box, and said means for attaching said pin comprises an orifice through said grasping portion.

* * * * *